United States Patent [19]

Bechler

[11] Patent Number: 5,029,761

[45] Date of Patent: Jul. 9, 1991

[54] LINER WEAR INSERT FOR VERTICAL SHAFT IMPACTOR ROTOR

[75] Inventor: David J. Bechler, Menomonee Falls, Wis.

[73] Assignee: Nordberg Inc., Milwaukee, Wis.

[21] Appl. No.: 443,908

[22] Filed: Nov. 30, 1989

[51] Int. Cl.[5] ..... B02C 19/00

[52] U.S. Cl. ..... 241/275

[58] Field of Search ..... 241/275, 300, 117-121, 241/182, 183, DIG. 30

[56] References Cited

U.S. PATENT DOCUMENTS 3,074,657 1/1963 Bridgewater .
3,154,259 10/1964 Behnke et al. .
3,881,664 5/1975 Bowling, Jr. et al. .
3,970,257 7/1976 MacDonald et al. .
4,065,063 12/1977 Johnson .
4,126,280 11/1978 Burk .
4,166,585 9/1979 Alford et al. .
4,787,564 11/1988 Tucker ..... 241/275

OTHER PUBLICATIONS

Corrosion Engineering Inc.: *Abrasion Resistant Rubber Products, Engineered for the Minning Industry,* undated, 4 pages.

*Primary Examiner*—Mark Rosenbaum
*Attorney, Agent, or Firm*—Welsh & Katz, Ltd.

[57] ABSTRACT

A liner wear plate for a vertical shaft impactor rotor includes at least one wear resistant insert disposed in the liner along a path of wear formed by particulate material passed through said rotor for comminution.

9 Claims, 2 Drawing Sheets

LINER WEAR INSERT FOR VERTICAL SHAFT IMPACTOR ROTOR

BACKGROUND OF THE INVENTION

The present invention generally relates to rotors of vertical shaft impact crushers, also known as vertical shaft impactors, and specifically provides a liner for such a rotor having at least one wear resistant liner insert positioned to maximize liner life.

Vertical shaft impact crushers operate on the principle of accelerating the rock or mineral material radially outwardly and causing it to impact against a target which will cause the rock to fracture. This operation is accomplished through the use of an axially rotating multi-chambered or pocketed rotor which receives the mineral material through a central opening, and then accelerates the material and ejects it from each chamber along a trajectory defined by a vertical vane.

In that one of the greatest costs associated with the operation of a vertical impactor is the replacement-/repair of worn or consumed components, the minimization of abrasive wear in specified components has been a long-standing design objective. Commonly-assigned U.S. Pat. No. 4,575,014 discloses that the floor of each of the rotor chambers must be protected from such abrasion, and that such protection may take the form of a replaceable wear plate or liner.

Rotor liners are typically subjected to concentrated wear along a relatively narrow path defined by the trajectory of material flowing through the rotor pockets. This concentrated wear usually results in wasted material, as the unworn portions of the liner must be discarded once the concentrated wear becomes unacceptable. Operational costs are substantial here, in that the liners are made of expensive cast iron alloy, and the relatively rapid wear in the concentrated wear zone requires frequent replacement of liners.

Thus, there is a need for a rotor liner which is more durable than liners currently available.

SUMMARY OF THE INVENTION

Accordingly, the present invention provides a rotor liner having at least one wear insert imbedded in the liner plate along the trajectory or path of maximum wear of the material through each rotor chamber. The inserts are made of extra-durable wear resistant materials. In a preferred embodiment, a plurality of inserts are disposed in generally end-to-end fashion along the entire trajectory of the material within each of the rotor chambers or pockets.

DESCRIPTION OF THE PREFERRED EMBODIMENT

Figure 1:
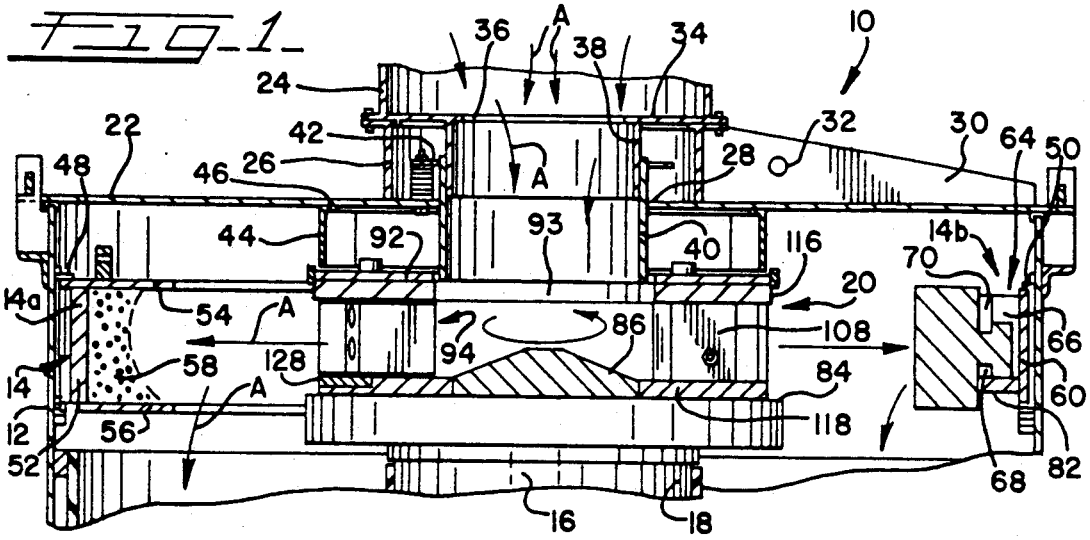
FIG. 1 is a partial sectional elevation of the upper end of a vertical impactor showing on the left side, an autogenous breaker ring; on the right side, an anvil breaker ring; and with the rotor shown in partial section taken along the line 1—1 of FIG. 2 and in the direction indicated generally.

Referring now to FIG. 1, a vertical shaft impact crusher generally designated 10 is partially shown in section. The impactor 10 is preferably of the type disclosed in commonly assigned U.S. Pat. No. 4,560,113; however, the present invention is contemplated for use in other types of vertical shaft impact crushers. The crusher 10 generally includes a generally cylindrical tank 12 having an annular breaker ring 14 mounted on an inner peripheral surface thereof. A central shaft 16 is centrally located for axial rotation within a bearing cartridge and an outer shield designated generally 18. A rotor 20 is secured to an upper end of the shaft 16 for coaxial rotation, and is disposed within the tank 12 so as to be horizontally aligned with the breaker ring 14. A cover plate 22 is located upon the tank 12 and may include a deep feed funnel 24 mounted on a collar 26. The collar 26 is welded to the cover 22 to circumscribe a central opening 28 in the cover plate 22. At least one and preferably three radially extending tapered braces 30 are welded to the collar 26 and to the cover plate 22 to strengthen the cover plate 22 and to provide, by virtue of a plurality of holes 32 in the braces 30, means for attaching a hoist cable (not shown) when it is desired to lift the cover plate 22 off of the crusher tank 12.

The feed funnel 24 has a floor plate 34 provided with a central opening 36. A feed tube 38 is welded to the underside of the floor plate 34 and depends therefrom to a level approximately coextensive with the cover plate 22. A replaceable feed tube extension 40 is telescopically disposed around the feed tube 38 and is provided with an extension adjustment mechanism for adjusting the length of its extension through the hole 28 in the cover plate 22. A guard shell 44 is bolted to the underside of the cover plate 22 concentrically around the central opening 28. The shell 44 is made of a series of generally arcuate segments, each being secured to the cover plate 22 by means of a flange 46. The guard shell 44 protects the top of the rotor 20 from damage by broken rock bouncing off of the breaker ring 14 or the interior of the housing 12. An annular seal 48 is located at the upper end of the breaker ring 14 and against the shell 12. The seal 48 prevents the accumulation of debris behind the ring 14 which may impede the ring's removal. The ring 14 may also be provided with a mechanism (not shown) for selectively adjusting its vertical position in the tank 12.

The breaker ring 14 may take one of two forms, both of which are illustrated in FIG. 1. On the left side of the crusher 10 in FIG. 1, an autogenous breaker ring 14*a* includes an annular cylinder 52 and upper and lower disks 54 and 56, respectively, the upper and lower disks each being welded to the annular cylinder 52. Upper and lower plates 54, 56 are configured to accumulate a bed of material 58 against the inner wall of the annular cylinder 52. The bed 58 functions as the crushing surface to achieve autogenous, or rock-on-rock crushing.

Figure 2:
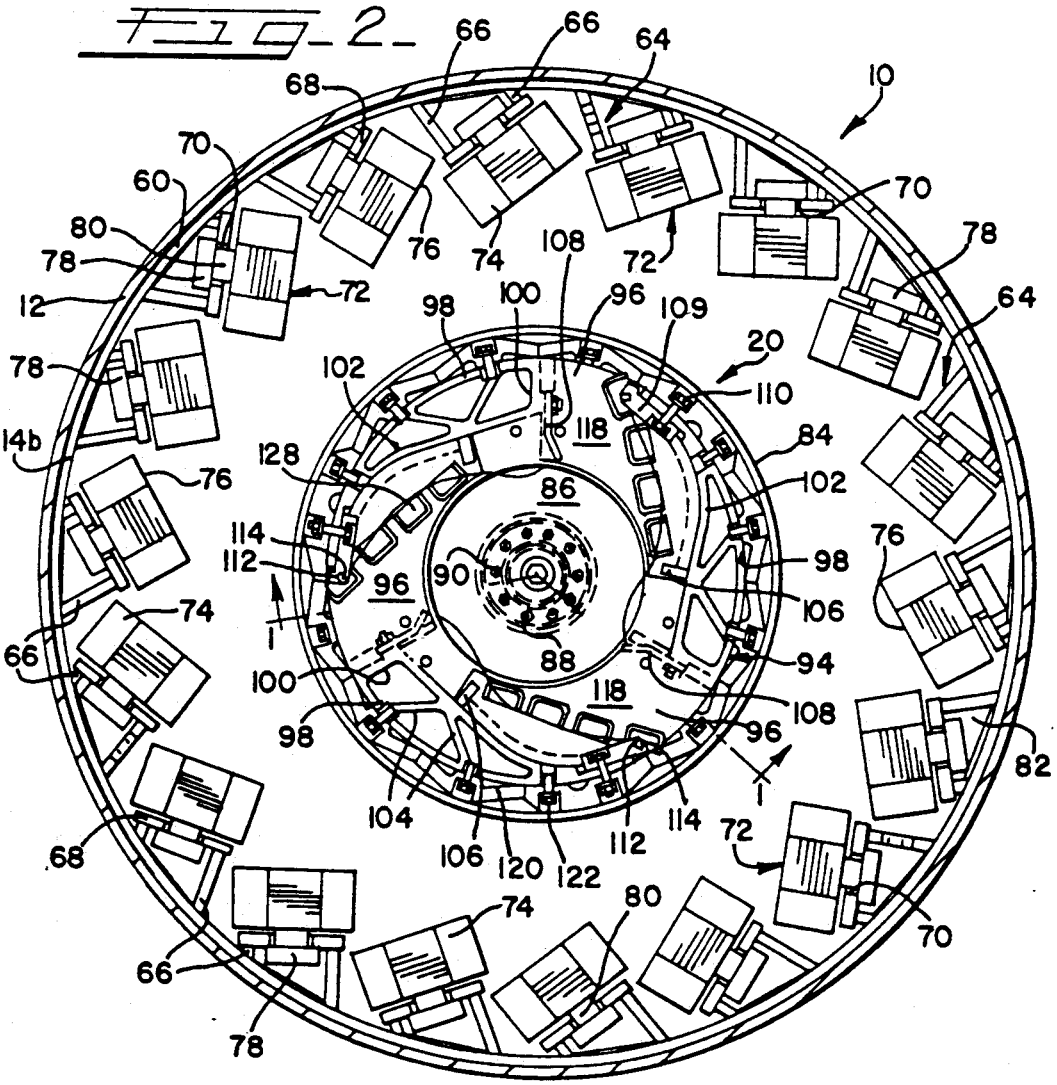
FIG. 2 is an overhead plan view of the rotor and anvil breaker ring of the vertical shaft impactor shown in FIG. 1, with portions of the rotor removed for clarity.

Referring now to FIGS. 1 and 2, the anvil type breaker ring 14*b*, shown on the right side of FIG. 1 and in FIG. 2, includes an annular hoop 60 of heavy steel construction with an annular seal 50 fastened to its top surface for sealing the space between the hoop 60 and the crusher tank 12. The breaker ring 14*b* includes a series of brackets 64, each welded to the hoop 60 and further provided with two legs 66 fastened to and extending inwardly from the hoop 60 on a general secant to the circle defined by the hoop. A cross arm 68 is welded to and extends between the outside ends of each pair of legs 66 and has a vertical slot 70 completely through the arm 68.

An anvil 72 is supported by each bracket 64 and includes an octagonal head 74 having a flat octagonal face 76, a square foot 78, and a narrowed squared neck 80 which connects the head 74 and the foot 78. The neck 80 is dimensioned to slidingly engage the slot 70 in the bracket 64, and the head 72 is angled relative to the tank 12 so as to most effectively receive rocks ejected from the rotor 20 at high velocities. The anvil 72 including its head 74, neck 80 and foot 78 is symmetrical about a horizontal axis. Each anvil 72 is supported on the bracket 64 by virtue of the engagement of the neck 80 in the slot 70 and by the foot 78 contacting a support plate 82 welded to the bottom of the bracket legs 66 and cross arm 68.

Figure 3:
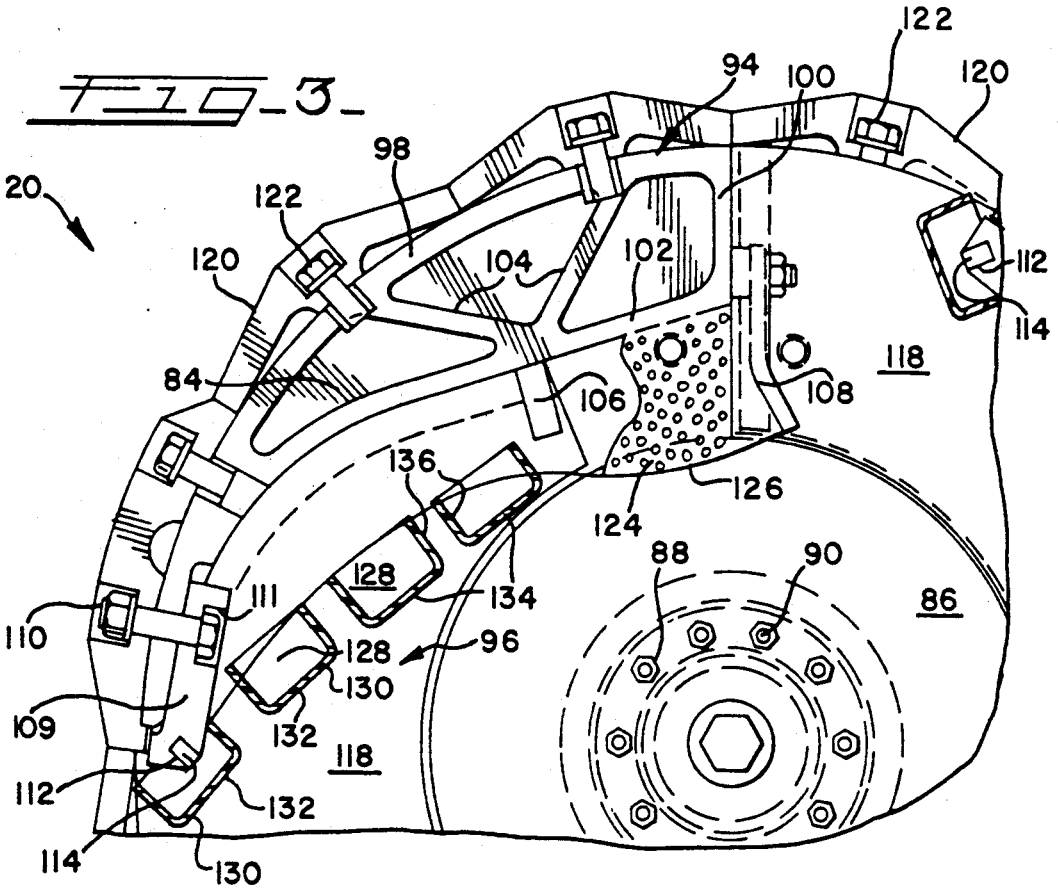
FIG. 3 is a plan view of a portion of the rotor shown in FIG. 2.

Referring now to FIGS. 1, 2 and 3, the rotor 20 includes a circular base plate 84 having at its center a hub 86. The hub 86 is provided with an annular ring of mounting holes 88 to enable the attachment of the rotor to the shaft 16 by means of a plurality of vertical bolts 90 which project from the top of the shaft. An upper or top plate 92 (best seen in FIG. 1) is disposed vertically above and parallel to the base plate 84 and is coaxial therewith. The top plate 92 has a central opening 93 into which the feed tube extension 40 is inserted. The top plate 92 is held in vertically spaced relationship to the base plate 84 by a series of vertically oriented partitions, designated generally 94, which form three autogenous pockets 96 spaced equally around the rotor 16. Each partition 94 includes an arcuate circumferential or peripheral plate 98, a generally radial plate 100 and a curved pocket floor plate 102. The three elements 98, 100, 102 of the partition 94 are preferably integrally formed, as by casting or welding. The partitions 94 are also provided with internal support members or gussets 104, a stub wall 106 located perpendicularly to the floor plate 102, and a trail plate 108.

Figure 4:
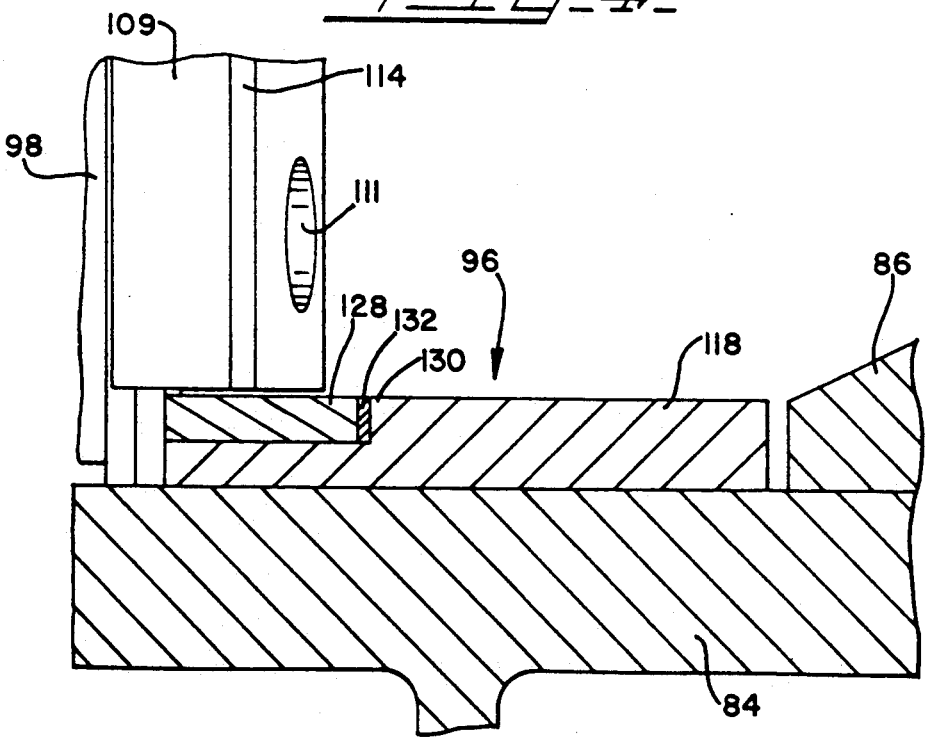
FIG. 4 is a fragmentary sectional elevational view of the rotor shown in FIG. 3.

The leading edge of each arcuate plate 98 is provided with a wear resistant bar 109 attached thereto by at least one bolt 110 disposed in a bolt hole 111 (best seen in FIG. 4). The wear resistant bar 109 preferably includes on its inside leading edge a slot 112 in which is fixed, as by silver soldering, a piece of hard wear resistant material 114 such as silicon carbide. The wall 106, the trail plate 108 and the bar 109 are the specific portions of the partition 94 upon which the top plate 92 rests and to which the plate 92 is secured.

A pair of upper and lower wear plates or liners 116, 118 are fixed to the rotor base plate 84 and the top plate 86, respectively, in each of the three pockets 96 of the rotor 20. The plates 116, 118 are contoured to the shape of the rotor pockets 96 so that their natural geometry and the centrifugal force generated by the rotating rotor 20 works to hold them in place. Each plate 116, 118 is generally coextensive with the pocket 96 and extends generally from the hub 86 to the outer peripheral edge of the base plate 84. The outer peripheral edge of the base plate 84 may optionally be provided with a plurality of replaceable wear members 120 (best seen in FIGS. 2 and 3), each of which being fastened to the base plate by a respective bolt 122. The members 120 protect the base plate 84 from damage due to rocks ricocheting within the housing 12.

The rotor 20 is designed so that the material flowing therethrough and which is represented by the arrows "A" (best seen in FIG. 1) accumulates between the trail plate 108 and the wear resistant bar 109 to form a bed 124 (best seen in FIG. 3). It has been found that during operation, a trajectory or path of maximum wear 126 develops upon the lower wear liner 118 along the outer edge of the bed 124.

Referring now to FIGS. 2-4, in order to prolong the life of the liner 118, a plurality of wear resistant inserts 128 is disposed in the liner in a general line which follows the path of wear 126 from the area of the hub 86 to the outer periphery of the base plate 84. The wear inserts 128 are significantly more wear resistant than the liner material in order to create a more uniform utilization of the liner material. The liner 118 is normally made of chrome-moly cast white iron, steel or other wear resistant materials. The inserts 128 may be made of tungsten carbide, silicon nitride, boron nitride or similar tungsten or ceramic-based wear resistant materials. Each insert 128 is located within a corresponding opening 130 in the liner 118. The inserts 128 are preferably held within the openings 130 by adhesive 132 such as a structural epoxy-type adhesive. In the preferred embodiment, the inserts 128 are generally rectangular in shape, having a pair of sides 134 and a pair of ends 136, the sides being longer than the ends. The inserts are preferably located upon the liner 118 in spaced, end-to-end relationship along the path 126. The spaced positioning of the inserts 128 is designed to protect the liner 118 from a "stepping-stone" pattern of wear caused by rocks skipping across the liner. Alternatively, the insert 128 may be made of a single piece disposed along the path 126.

In operation, material is introduced down the feed funnel 24 and enters the rotor 20 through a central opening 93. Through the action of centrifugal force, the bed 124 of material becomes built up in the rotor 20 along and against the pockets 96 along the path 126. Once the bed 124 of material has been built up within the pocket 96, additional material passing through the rotor 20 impacts the bed along the path 126 prior to its ejection from the rotor and against the anvils 72 or against the autogenous bed 58. The broken material is then allowed to fall vertically through the base of the machine 10.

It will be evident that the use and disposition of the wear resistant inserts 128 will prolong the life of the lower rotor liner 118, thus decreasing the frequency of machine down-time for the replacement of that component. In addition, when the rotor liners 118 become due for replacement, the wear will be more balanced throughout the entire piece, thus using the materials of the liner 118 more efficiently than in prior versions.

While a particular embodiment of the liner wear insert for a vertical shaft impactor rotor of the invention has been shown and described, it will be appreciated by those skilled in the art that changes and modifications may be made thereto without departing from the invention in its broader aspects and as set forth in the following claims.

What is claimed is:

1. A wear liner for a vertical shaft impactor rotor, the rotor being rotatable about a central axis, having an outer periphery, a base plate, a hub and a plurality of pockets defined by partitions, the rotor configured for receiving a flow of particulate material introduced at a central axial portion and for ejecting the material generally radially outwardly at high velocity, such operation creating a path of concentrated wear along a trajectory of the material through each pocket, said liner comprising:

a liner plate adapted to be releasably fixed on the base plate of the rotor in each of the rotor pockets and generally extending from the central portion at least to the periphery, said liner plate including a plurality of wear resistant inserts selectively and linearly disposed in said plate only along the path of concentrated wear extending from a portion of said liner plate adjacent the hub to a portion of said liner plate adjacent the periphery of the base plate.

2. The liner as defined in claim 1 wherein said inserts are generally rectangular in shape, having two sides and two ends, said sides being generally longer than said ends.

3. The liner as defined in claim 2 wherein a plurality of said inserts are positioned generally end-to-end along said path.

4. The liner as defined in claim 1 wherein said inserts are made of a material which is more wear resistant than the material of said plate.

5. The liner as defined in claim 1 wherein said liner is adapted to be releasably placed within one of the pockets and is held therein by virtue of its external geometry and centrifugal force generated by the rotating rotor.

6. A rotor for a vertical shaft impactor having a central axially rotating shaft, said rotor comprising:

a generally circular base plate with an outer periphery and a central hub configured for placement on the shaft;

a plurality of vertical partitions secured to said base plate so as to define a plurality of pockets;

an upper plate being generally codimensional with said base plate and being supported in vertically spaced relationship from said base plate by said partitions;

a wear liner configured for releasable placement upon said base plate in each of said pockets, each said liner extending generally from said outer periphery of said base plate to said hub; and a plurality of wear resistant inserts being selectively and linearly disposed in said liner only along a line of concentrated wear formed by particulate material passing through each of said pockets, said line extending from a portion of said liner adjacent said hub and extending to a portion of said liner adjacent said outer periphery of said base plate.

7. The rotor as defined in claim 6 wherein said inserts are generally rectangular in shape, having two sides and two ends, said sides being generally longer than said ends.

8. The rotor as defined in claim 7 wherein a plurality of said inserts are positioned generally end-to-end along said path.

9. The rotor as defined in claim 6 wherein said inserts are made of a material which is more wear resistant than the material of said plate.

* * * * *